US006068310A

United States Patent [19]

Fuller et al.

[11] Patent Number: 6,068,310

[45] Date of Patent: May 30, 2000

[54] HOIST RING

[75] Inventors: Harry P. Fuller, Newbury; James C. Klingenberg, Concord, both of Ohio

[73] Assignee: Jergens, Inc., Cleveland, Ohio

[21] Appl. No.: 09/148,010

[22] Filed: Sep. 4, 1998

[51] Int. Cl.[7] ..... B66C 1/66

[52] U.S. Cl. ..... 294/1.1; 294/89; 403/78; 403/164

[58] Field of Search ..... 294/1.1, 89, 82.1; 403/78, 79, 119, 164

[56] References Cited

U.S. PATENT DOCUMENTS

| | | | |
|---|---|---|---|
| 3,297,293 | 1/1967 | Andrews et al. . | |
| 3,371,951 | 3/1968 | Bryant | 294/89 |
| 3,628,820 | 12/1971 | Blatt | 294/1.1 |
| 3,905,633 | 9/1975 | Larson . | |
| 4,558,979 | 12/1985 | Andrews . | |
| 4,570,987 | 2/1986 | Wong et al. . | |
| 4,592,686 | 6/1986 | Andrews . | |
| 4,641,986 | 2/1987 | Tsui et al. . | |
| 5,352,056 | 10/1994 | Chandler | 403/79 |
| 5,405,210 | 4/1995 | Tsui . | |
| 5,586,801 | 12/1996 | Sawyer et al. | 294/1.1 |
| 5,743,576 | 4/1998 | Schron, Jr. et al. . | |

FOREIGN PATENT DOCUMENTS

| | | |
|---|---|---|
| 365430 | 4/1990 | European Pat. Off. . |

OTHER PUBLICATIONS

Jergens, Inc.—1997 catalog entitled "Hoist Rings".

*Primary Examiner*—Dean J. Kramer
*Attorney, Agent, or Firm*—Vickers, Daniels & Young

[57] ABSTRACT

In a side-pull hoist ring having a load carrying ring, a clevis pivotally supporting the load carrying ring for rotation about a first axis and a post assembly extending through the clevis and fixedly engageable with a threaded bore on a load for allowing 360° rotation of the clevis about a second axis generally perpendicular to the load. The post assembly includes a lower support bushing with a large diameter lower load bearing flange and a bolt receiving passageway coaxial with the second axis; a bolt extending through the passageway into the threaded bore of the load where the bolt has a head carrying an upper flange member coacting with the lower flange to capture the clevis and a shank. There is a first cylinder groove in the passageway and a second cylindrical groove around the shank. The grooves are axially aligned when the lower flange and the upper flange capture the clevis. An arcuate spring element having a collapsed shape generally retained in the second groove and a relaxed shape bottomed out in the first groove and extending between the first and second grooves prevents non-destructive axial removal of the bolt from the bushing. The clevis is formed from extruded steel, bar stock or a steel plate.

68 Claims, 6 Drawing Sheets

HOIST RING

BACKGROUND OF INVENTION

The present invention relates to a hoist ring of the type used to lift a variety of heavy loads or objects, such as die sets and molds; however, the invention has much broader applications and may be used for a variety of applications where it is necessary to secure a ring to a structure, either to lift the structure or to hold down a structure such as containers, air crafts, air vehicles, boats, etc. Through the years, a large number of hoist devices has been developed which allow for a ring to be connected to the hook of a hoist wherein the ring pivots and swivels for the purpose of automatically adjusting the disposition of the ring with respect to the force being applied to the hoist during the lifting procedure. Such devices are found in patents incorporated by reference herein. Most of these devices are center-pull hoist rings where a post assembly extends through and allows 360° rotation of a support member. The rotating support member carries the load lifting ring, which is normally in the form of a U-shaped clevis. The clevis pivots through the center axis of the rotating support member and has a pivot arc of about 180°. Although the center-pull hoist ring is common in the patented art, the side-pull hoist ring is widely used. Like the center-pull style, the side-pull hoist ring includes a rotating support member mounted onto the load by a post assembly. In a side-pull hoist ring, the support member is generally U-shaped to define an outer bight portion in which a circular load ring is pivotally mounted. The circular load ring is offset from the axis of the center post assembly. Consequently, there are substantial forces created by the use of a side-pull hoist ring. Such hoist rings have heretofore included a cast metal clevis for supporting the load ring. The use of a casting for the clevis has substantial disadvantages. Since each clevis must have structural integrity they are individually inspected by a variety of techniques, such as magnetic particle inspection. In the field, a rejection rate as high as 25% is not uncommon. Consequently, inventory and ordering practices are difficult to control. If an order of clevises has a high rejection rate, there are insufficient useable clevises for scheduled production runs. To compensate for this eventuality, excess clevises are ordered. If they have a low rejection rate, a high inventory exists, which is quite expensive and wasteful. Consequently, the use of a cast clevis for a side-pull hoist ring is not advantageous. In addition, side-pull hoist rings have included a bushing on the post assembly with a limited diameter that causes an increased force on the clevis when the load ring is pulled at 90° from the support surface and/or pulled around the corner of a die set or mold. Such small bushings used in side-pull hoist rings drastically reduce the bearing area with the load and increases forces when the side-pull hoist ring is operated in various positions.

The swivel action of a side-pull hoist ring is accomplished by a post assembly including a bolt and bushing, which design requires an external snap ring to hold the bushing in place and an internal snap ring to hold the bolt with respect to the bushing. In a like manner, most center-pull hoist rings include a snap ring between the bushing and bolt at the bottom of the bushing, similar to the structure shown in Andrews U.S. Pat. No. 4,592,686. Such constructions are extremely expensive and can be disassembled in the field, which allows use of replacement bolts not particularly constructed for use in a hoist ring. The use of externally exposed snap rings is common practice; however, such procedure presents certain disadvantages in the field.

SUMMARY OF INVENTION

The present invention is an improvement in the art of hoist rings. This improvement is particularly applicable and advantageous for side-pull hoist rings and it will be described with particular reference thereto; however, the invention has broader applications and may be equally applicable to center-pull hoist rings as long as the hoist ring includes a post assembly extending through the swivel support member and a load ring that pivots on the support member. In accordance with the present invention, the improved hoist ring has the advantages of an eye bolt or a pivoted ring, while also obtaining the desirability and benefit of allowing the load ring itself to rotate through a full circle. In accordance with the present invention there is provided an improvement in a hoist ring for fixed engagement in a threaded bolt on the outer surface of a load member, such as a die or mold. The hoist ring has a load carrying ring, a support member pivotally supporting the load carrying ring for rotation about a first axis generally parallel to the surface of the load member. In both side-pull and center-pull hoist rings, the load ring itself, which is either a full ring or a clevis, pivots about an axis on the swivel support member. This type of hoist ring includes a center post assembly extending through the support member and fixedly engageable with the threaded bore for allowing 360° swivel or rotation of the support member about an axis perpendicular to the surface on which the hoist ring is mounted. The invention involves an improvement in this type hoist ring wherein the post assembly includes a lower support bushing, with a lower load bearing flange and a bolt receiving passageway coaxial with the perpendicular axis around which the support member rotates. A bolt extends through passageway of the bushing to engage the threaded bore in the load being carried. This bolt has a head including an upper flange member coacting with the lower flange member to capture the swivel support member between the two flanges and a shank, with means for locking the shank of the bolt in the passageway of the bushing. This improvement is primarily applicable to side-pull hoist rings, even though it can be used with the more common center-pull hoist ring.

The upper flange of the bolt is preferably an integral portion of the bolt so the post assembly includes merely a bolt and a bushing, with the bolt locked into the bushing so that it can not be removed. To accomplish this locking aspect of the invention there is provided a first cylindrical groove in the passageway of the bushing and a second cylindrical groove around the shank of the bolt. These two grooves are axially aligned when the lower flange of the bushing and the upper flange of the bolt capture the swivel support member between the two flanges. An arcuate spring element has a collapsed shape generally retained in the second groove of the shank of the bolt and a relaxed shape bottomed out in the first groove and extending between the two grooves to prevent non-destructive removal of the bolt from the bushing. This is a locking action between the bolt and bushing forming the post assembly. The post assembly can not be disassembled since the locking arrangement is hidden. The bushing has two features. First, the lower large diameter flange gives a large contact area of support for the hoist ring. Second, the bushing forms a hidden locking mechanism between the shank of the bolt and the bushing to permanently lock the bolt in the bushing.

In accordance with another aspect of the present invention, the upper flange carried by the bolt is a separate washer held by the head of the bolt onto the top of the bushing. As the bolt is pushed into the bushing, the washer or upper flange engages the top of the bushing when the grooves, constituting the lock means, are in axial alignment. The same effect is accomplished when the upper flange is integral with the bolt. In this instance, the top of the bushing engages a cylindrical shoulder on the shank of the bolt to determine the assembled position of the post assembly with the locking grooves in axial alignment. In both of these instances, the bushing has a generally conical lead-in portion above the first cylindrical groove in the passageway of the bushing. The conical lead-in portion forms an angle with respect to the perpendicular axis of the post assembly so the spring element carried by the shank of the bolt is cammed inward into the groove in the bolt, which groove is deep enough to accommodate the movement of the shank axially within the bushing. When the two grooves are axially aligned, in the preferred embodiments with the top of the bushing engaging either the washer or shoulder on the shank, the spring element relaxes into the groove of the passageway. This groove is fairly shallow. The spring element forms an interference fit between the shank and bushing with the spring element held in its locked position. The bolt can not be removed from the bushing of the post assembly without destruction of the spring element, which element is hardened spring steel and not easily sheared. Thus, the post assembly has a lower flange with a large contact area engaging the load being lifted and a hidden locking mechanism between the shank of the bolt and the passageway of the bushing to hold the bolt and bushing locked together after assembly by the manufacturer of the hoist ring.

In accordance with another aspect of the present invention, the clevis of the side-pull hoist ring is formed from a bent sheet steel, an extruded steel, steel bar stock or an extruded steel element machined to produce the U-shaped configuration. By producing the clevis in this manner, the disadvantages of cast clevis and the uncertainty of rejection rates is overcome. In addition, the improved hoist ring including the novel locked bushing and bolt. This concept substantially decreases the cost and increases the performance of a side-pull hoist ring. As a secondary application, the invention is adapted for use in a center-pull snap hoist ring even though this is not the preferred implementation of the invention.

In accordance with another aspect of the present invention, there is provided an improvement in a side-pull hoist ring of the type fixed into a threaded bore on the outer surface of a heavy load to be carried. The side-pull hoist ring has a load carrying ring and a support member mounted for rotation about an axis perpendicular to the outer surface of the load. The hoist ring includes a post assembly extending through the support member and fixedly engaging the load being carried. In this manner, the side-pull hoist ring can rotate 360°. The improvement in this type of side-pull hoist ring includes constructing the post assembly with a support bushing having a lower load bearing flange which is relatively large in diameter. A bolt receiving passageway in the bushing is coaxial with the perpendicular rotational axis of the support member. The bolt extends through the passageway into the threaded bore holding the side-pull hoist ring onto the load. The bolt has a head carrying a large upper flange that coacts with the lower flange to capture the support member between the flanges. The support member is a generally U-shaped clevis with aligned holes receiving the post assembly and a bight portion receiving the continuous load ring of the hoist ring. By providing a bushing with a large area for a side-pull hoist ring, the lever arm created when the ring is pulled perpendicularly around the corner of a die is reduced. This substantially reduces the forces created on the side-pull hoist ring. In accordance with still a further aspect of the present invention there is provided a clevis for a side-pull hoist ring, which clevis is formed as a bent piece of steel, extruded steel or bar stock. The primary object of the present invention is the provision of an improved hoist ring, which hoist ring has a post assembly providing a large diameter support flange and a locking mechanism for permanently locking the bolt and bushing forming the post assembly.

Yet another object of the present invention is the provision of an improved hoist ring, as defined above, which hoist ring has a clevis formed from bent steel, extruded steel or bar stock.

Another object of the present invention is the provision of an improved hoist ring, as defined above, which hoist ring is permanently assembled by the manufacturer and reduces the reactive forces when the hoist ring is maneuvered into various positions.

Still a further object of the present invention is the provision of an improved hoist ring, as defined above, which hoist ring has an integral ring which can rotate about its support assembly 360° while the support assembly swivels through 360°.

Another object of the present invention is the provision of an improved hoist ring, as defined above, which hoist ring is economical to manufacture, requires a lesser amount of part inventory and has an appearance of strength and integrity.

A further object of the present invention is the provision of an improved hoist ring, as defined above, which hoist ring has no exposed snap rings allowing easy disassembly in the field.

Yet another object of the present invention is an improved hoist ring, as defined above, which hoist ring has a hidden locking mechanism in a post assembly with a large load bearing flange.

These and other objects and advantages will become apparent from the following description taken together with the accompanying drawings.

PREFERRED EMBODIMENT

Figure 12:
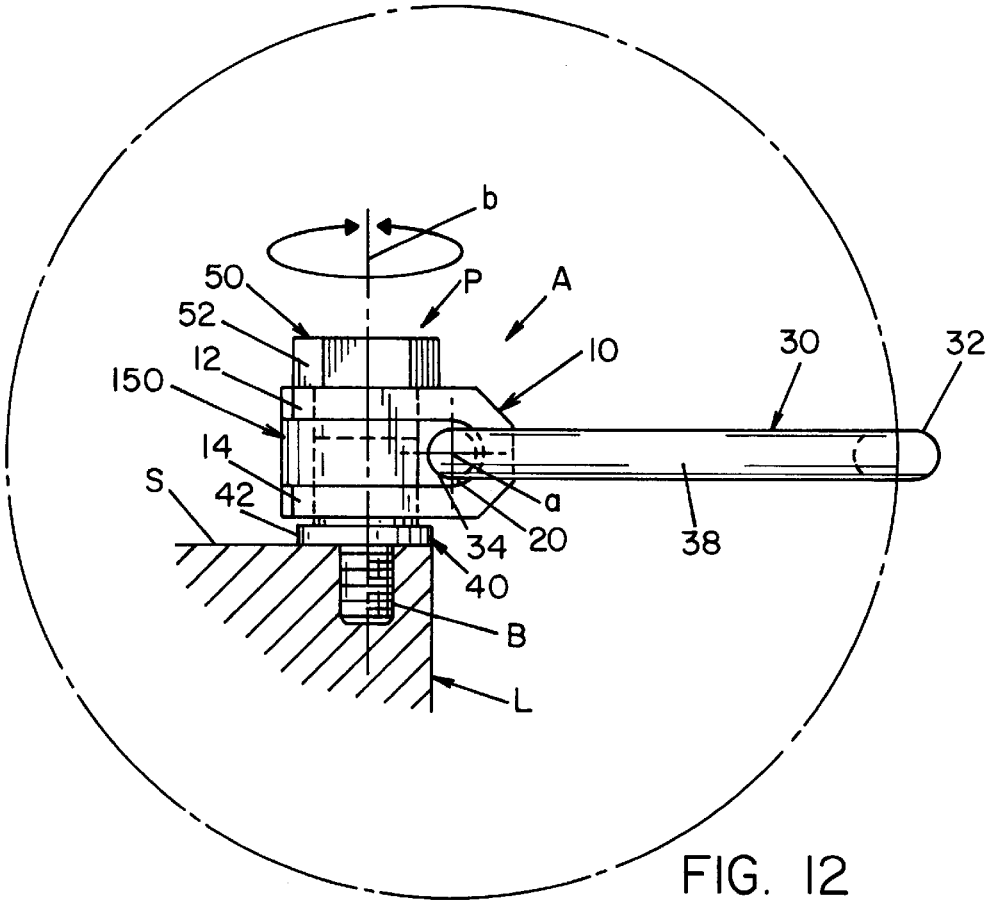
FIG. 12 is a side view of the preferred embodiment of the present invention assembled onto the edge of a load member to be lifted; and, FIG. 13 is a view as shown in FIG. 12 with the continuous load ring extending perpendicular to the surface on which the invention is mounted to cause a pulling action around the corner of the load member.
Figure 13:
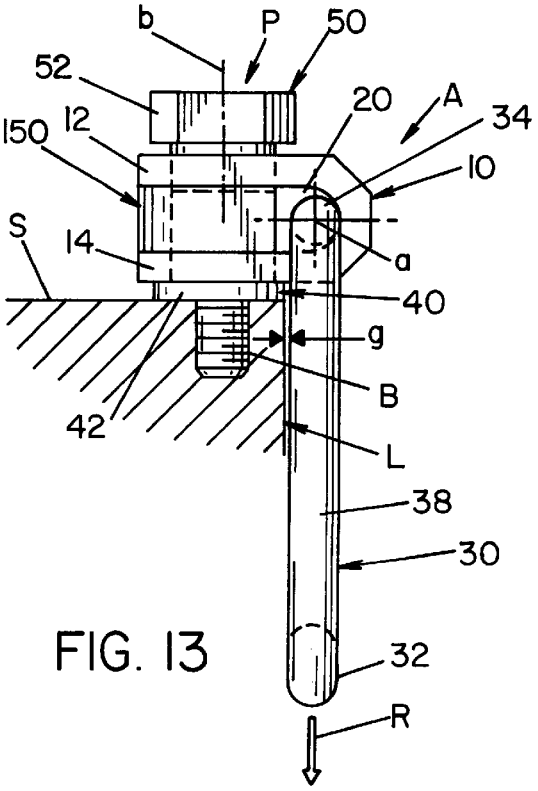

Referring now to the drawings wherein the showings are for the purpose of illustrating the preferred embodiment only and not for the purpose of limiting same, FIGS. 1–4 show a side-pull hoist ring A constructed in accordance with the preferred embodiment of the invention and FIGS. 12 and 13 illustrate how hoist ring A is secured in a threaded bore B perpendicular to the surface S of a heavy load L to be lifted in accordance with standard use of hoist rings. Ring A includes a rotatable support member 10 in the form of a U-shaped clevis with generally parallel legs 12, 14 having holes 16, 18 for mounting the clevis to rotate about axis b perpendicular to surface S. Clevis 10 includes an outboard bight 20 that receives one end of continuous load ring 30. The load ring can be generally circular, but is illustrated as elongated in the preferred embodiment. This elongated continuous load ring includes a larger cross sectioned enlarged end 32 and a generally straight smaller end 34 that is pivotally mounted in bight 20 of swivel mounted support member 10 to rotate or pivot about axis a generally parallel to surface S. Diverging legs 36, 38 connect large end 32 with small end 34 to allow load ring 30 to rotate about axis a through 360°, if there were no interference with the load as shown in FIGS. 12 and 13. Pivotal axis a is generally orthogonal to swivel axis b of support member 10 to allow both 360° swivel action as well as 360° pivoting of load ring 30. By using diverging legs 36, 38, the outboard end of ring 30 at portion 32 will accommodate a large hook on the hoist that lifts load L. In addition, the diverging configuration of load ring 30 prevents necking down of the load ring when extra heavy loads are being manipulated by hoist ring A. To swivel mount clevis or support member 10 about axis b through the center line of bore B there is provided a center post assembly P, best shown in FIG. 7. Post assembly P includes a lower bushing 40 with a large diameter load bearing flange 42 adapted to engage surface S when post assembly P is extended through holes 16, 18 of clevis 10. Flange 42 is substantially larger in diameter than hole 18. Bushing 40 includes an upstanding cylindrical body 44 with a generally flat shoulder or top 46 and a central bolt receiving passageway 48. Passageway 48 has a smaller diameter portion 48*a* and an enlarged portion 48*b*. A bolt 50, having an enlarged head 52 in the form of a large diameter upper flange and a shank 54 extending through passageway 48 into bore B connects the bushing and swivel support member 10 onto load L. As illustrated, bolt 50 includes shank 54 with an upper enlarged cylindrical portion 56 with a lower facing shoulder 58 to coact with top or shoulder 46 of bushing 40 to define the axial assembled position of the bolt with respect to bushing 40. Threads 60 of shank 54 engage the threads of bore B. Post assembly P is assembled by axial movement of bolt 50 into passageway 48 of bushing 40. By clamping the shoulders 46, 58 together during tightening of post P into bore B, hoist ring A is fixedly secured to load L. Rotational axis a of load ring 30 is offset from axis b of post assembly P to define a side-pull style hoist ring. Head 52 of bolt 50 forms an upper flange that coacts with lower flange 42 to capture the swivel mounted support member or clevis 10. Head 52 could be a separate washer with a distinct separate head for bolt 50 so the washer would form the upper flange to capture clevis 10 in the assembled condition. In accordance with another implementation of the present invention, a center-pull hoist ring, as shown in Andrews U.S. Pat. No. 4,592,686, could be provided wherein the swivel support member is a circular body with a center opening for post assembly P. In that embodiment, load ring 30 would be a U-shaped clevis pinned to the support member 10 in accordance with standard practice.

The operation of hoist ring A is shown in FIGS. 12 and 13. The side-pull hoist ring is mounted at the edge of load L. Consequently, load ring 30 can pull post P at a substantial obtuse angle, which pull angle in FIG. 13 is nearly 180°. This pulling action tends to bend post P; however, by using a large diameter lower flange 42 below support member 10 this bending action is decreased. Side-pull hoist rings have the size of the lower bearing surface of the post assembly limited to the diameter of hole 18. By using the large load bearing flange below support member 10, the bending forces are distributed. Consequently, the use of a large flange in a side-pull hoist ring, as contemplated by the present invention, is a mechanism for distributing load especially when the side-pull hoist ring is being lifted at an extremely oblique angle. Gap g is the lever arm between the direction of pull shown as arrow R in FIG. 13 and the post assembly. This gap is quite small. When load ring 30 is pulled at 90°, as shown in FIG. 12, the post assembly tends to pivot around the edge of flange 42, instead of shank 54. This stabilizes the post assembly.

Figure 5:
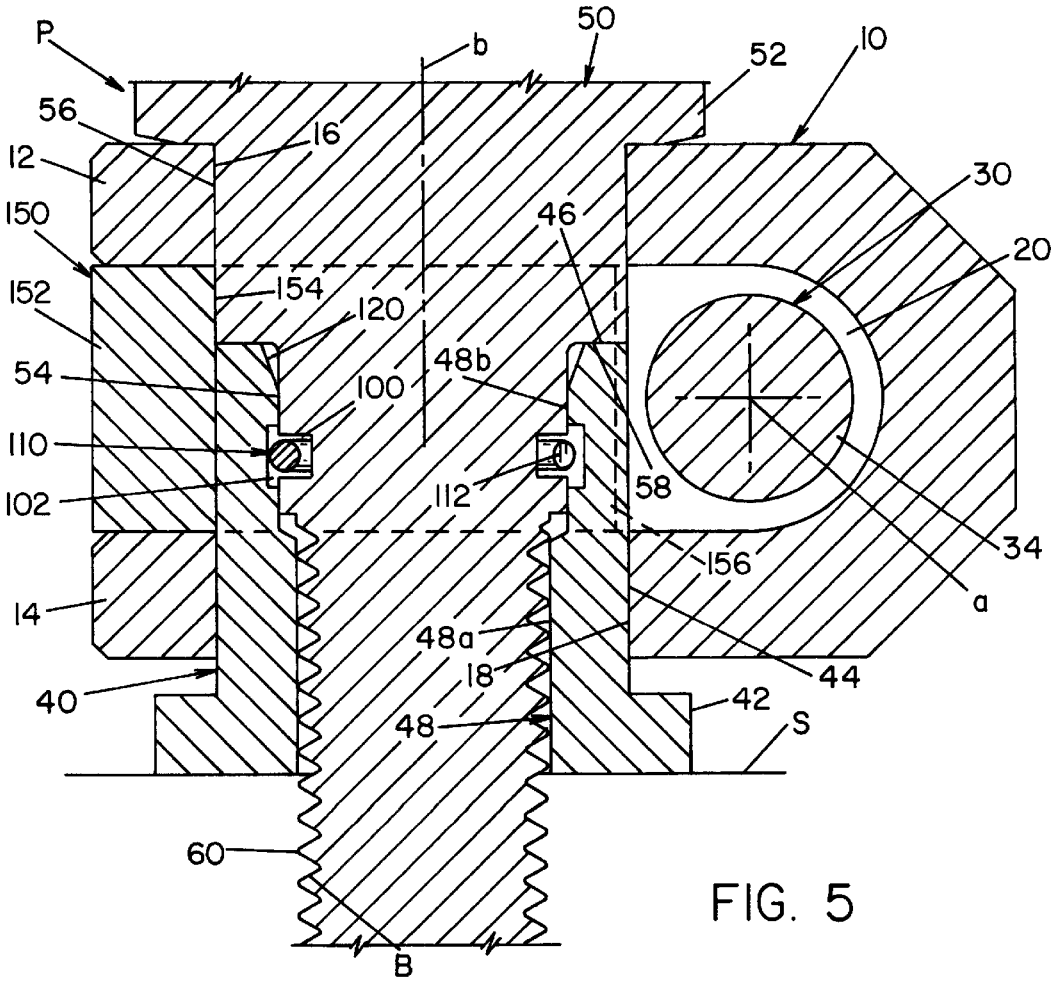
FIG. 5 is an enlarged cross sectional view through the U-shaped clevis and post assembly of the present invention.
Figure 6A:
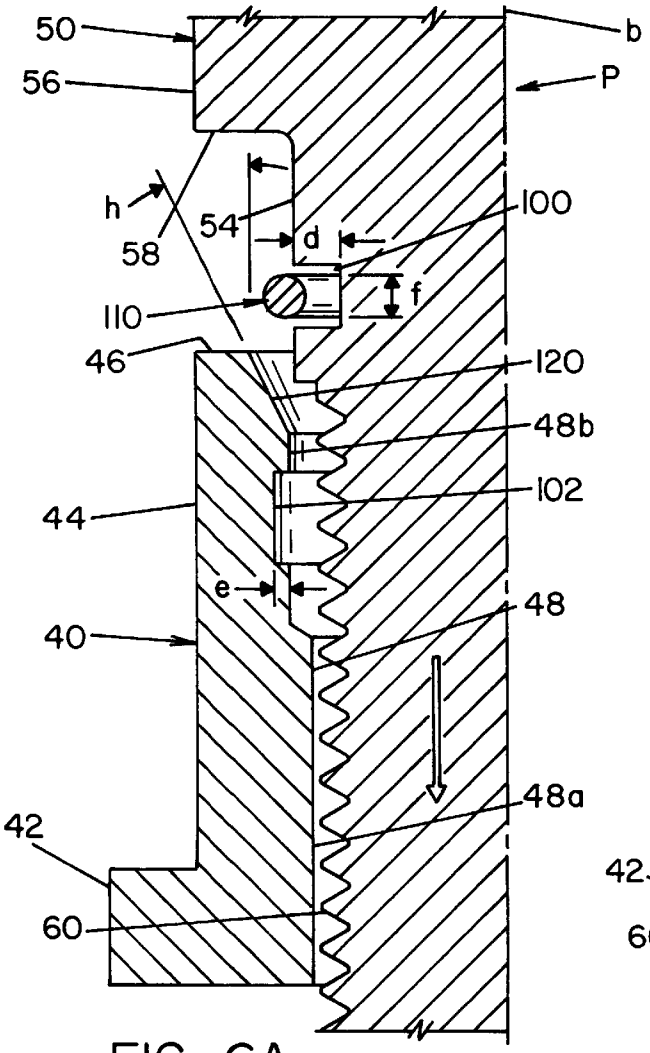
FIGS. 6A–6C are partial views schematically illustrating the hidden locking feature used in the present invention.
Figure 6B:
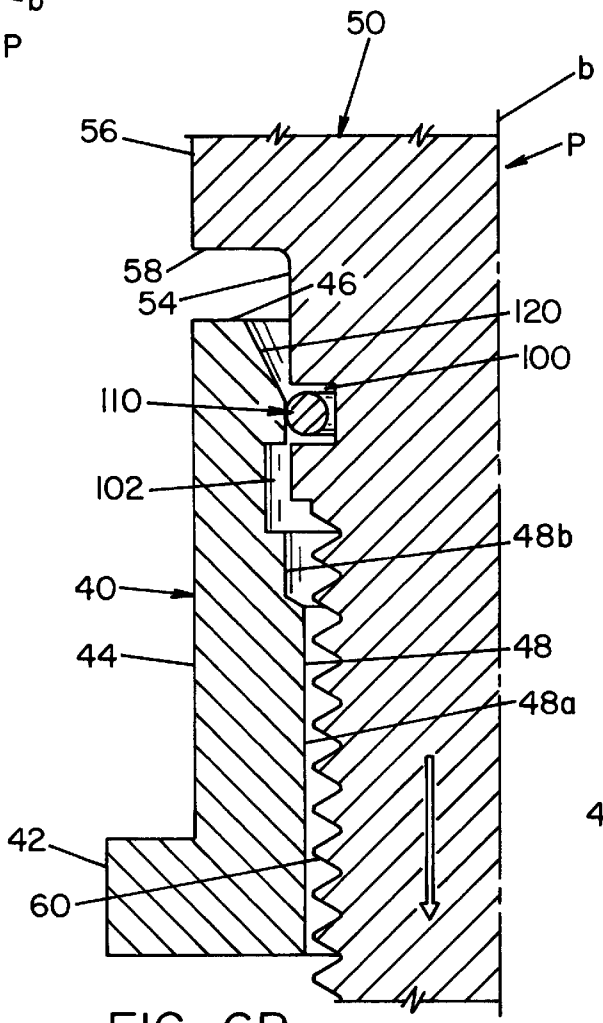
Figure 6C:
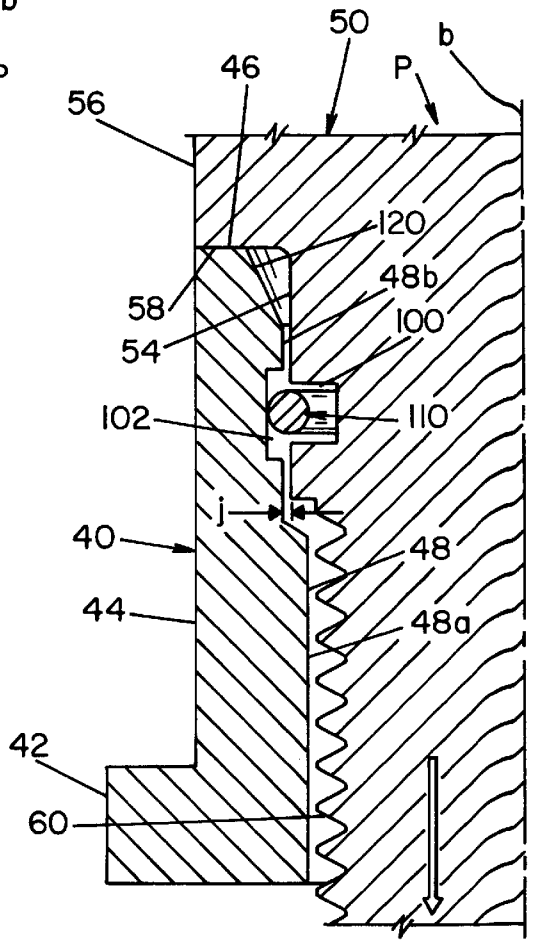
Figure 7:
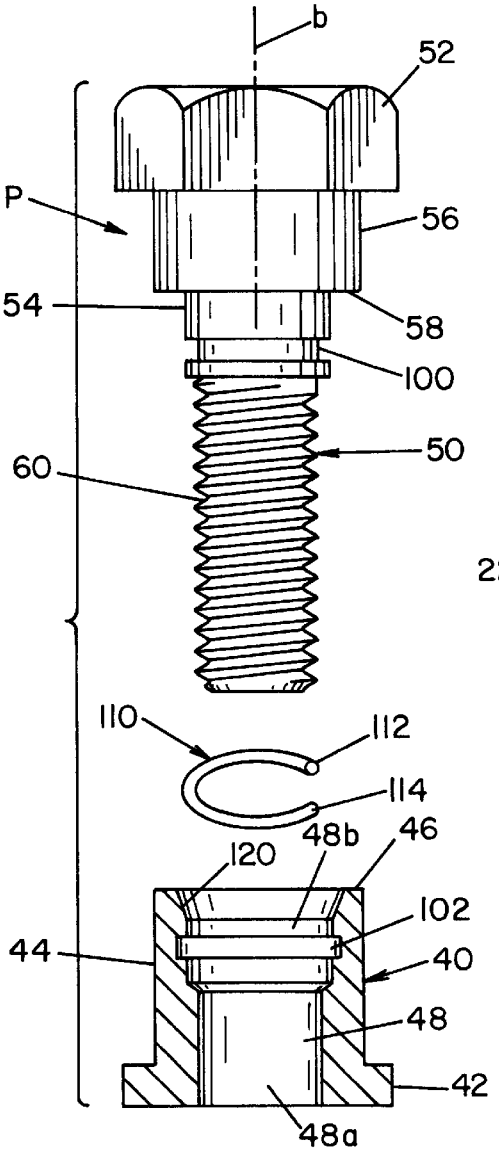
FIG. 7 is an exploded view showing the post assembly used in the preferred embodiment of the present invention.

In accordance with another aspect of the present invention, post assembly P that rotationally mounts clevis 10 has not only a large diameter, lower load bearing flange 42, but also a novel hidden lock mechanism that has no exposed snap rings and presents non-destructive disassembly of the hoist ring in the field. This unique hidden locking mechanism is illustrated in FIGS. 5–7 and includes a first cylindrical groove 102 in cylindrical passageway 48 adapted to receive bolt 50. Depth e of groove 102 and the depth d of a second cylindrical groove 102 in shank 54 are selected to receive a C-shaped spring element 110 with spaced ends 112, 114, as best shown in FIG. 7. As illustrated in FIG. 6A, the cross section of spring element 110 has a diameter of maximum dimension f allowing the spring element to be carried by groove 100. Depth d of groove 100 is substantially greater than diameter f of element 110, thus allowing element 110 to be collapsed into groove 100 during assembly. Ends 112, 114 are spaced sufficiently to facilitate this collapsing action of spring element 110. Depth e of cylindrical groove 102 in cylindrical body 44 is substantially less than diameter f of spring element 110. Consequently, when grooves 100, 102 are axially aligned, spring element 110 takes the relaxed position shown in FIGS. 5 and 6C. In this relaxed position, bolt 50 is locked within bushing 40. The bolt can not be removed without destruction of the spring element which is formed of high strength spring steel, such as a partial coil spring convolution. When bolt 50 is pushed into bushing 40 through clevis 30, post assembly P is fixedly secured and locked together by a hidden locking mechanism. Threads 60 are smaller than portion 48*a* of passageway 48. Thus, bolt 50 is rotated to mount hoist ring A on load L as shown in FIGS. 12 and 13 by having threads 60 engage the threads of bore B. To facilitate the axial assembly of bolt 50 in bushing 40, cylindrical body 44 has a conical lead-in 120, best shown in FIGS. 5 and 6A–6C. The conical surface of lead-in 120 forms an angle h with axis b, which lead-in angle is in the range of about 15°–30°. Lead-in portion 120 cams spring element 110 into groove 100 as bolt 50 is moved downwardly into passageway 48 of bushing 40. When the cylindrical grooves are aligned, spring element 110 bottoms out against the bottom surface of groove 102 to project outwardly beyond groove 102 a distance at least greater than the clearance j between bolt shank 54 and the surface of passageway 48. In the illustrated embodiment, passageway 48 has a smaller diameter portion 48*a* and a larger diameter portion 48*b* at the grooves 100, 102. The upper portion of shank 54 is slightly larger in diameter than the lower portion where threads 60 are formed. Other configurations for the passageway and bolt shank could be made without departing from the intended scope of the present invention.

Figure 1:
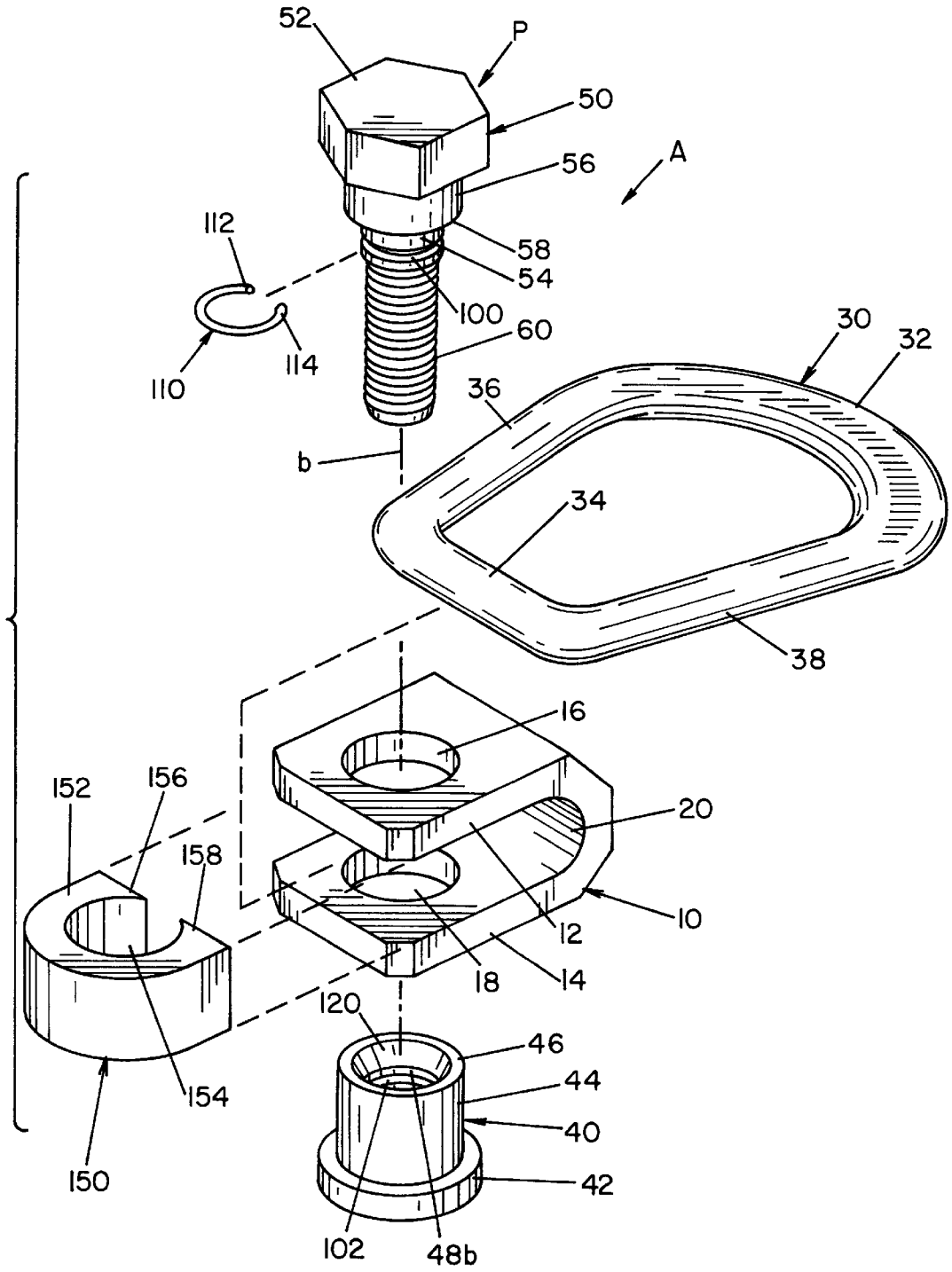
FIG. 1 is an exploded view of the preferred embodiment of the present invention.
Figure 2:
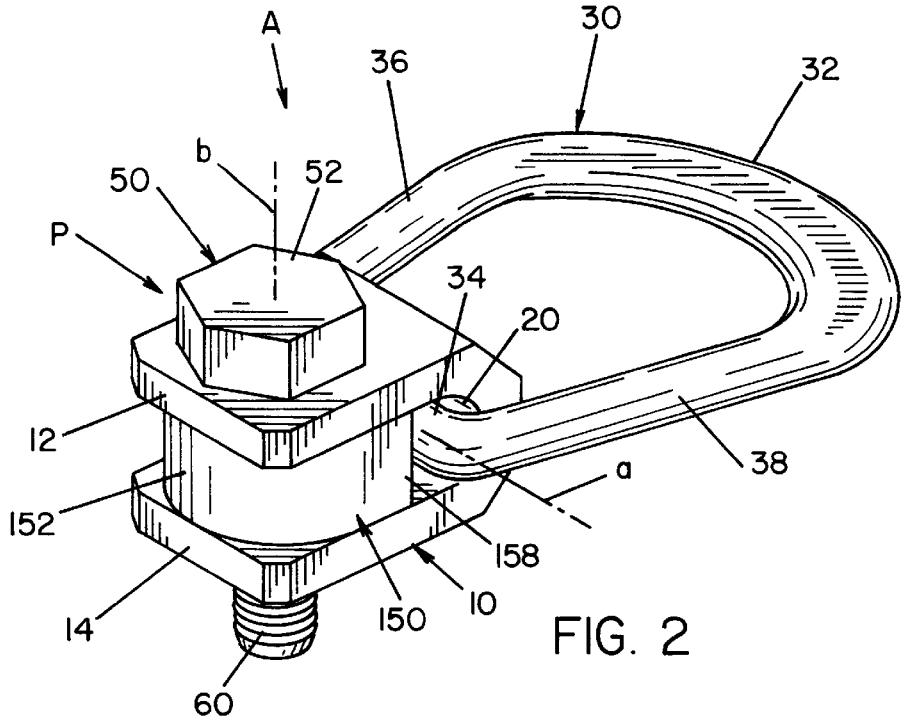
FIG. 2 is a pictorial view of the preferred embodiment of the present invention.
Figure 3:
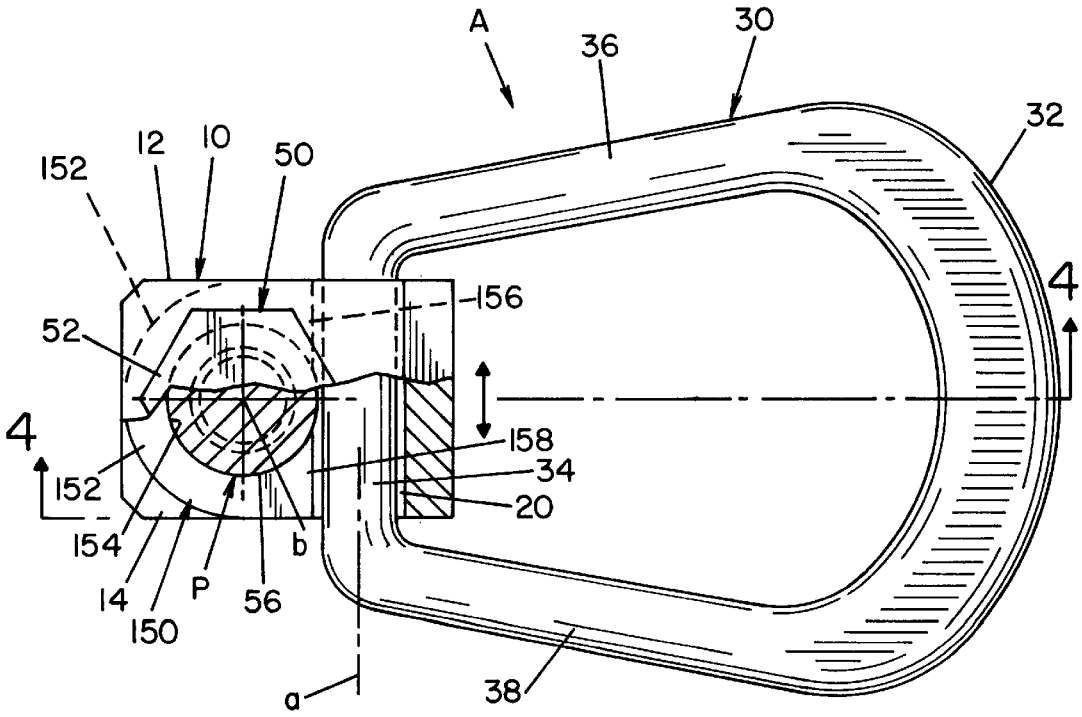
FIG. 3 is a partially cross sectional top view of the preferred embodiment of the present invention.
Figure 4:
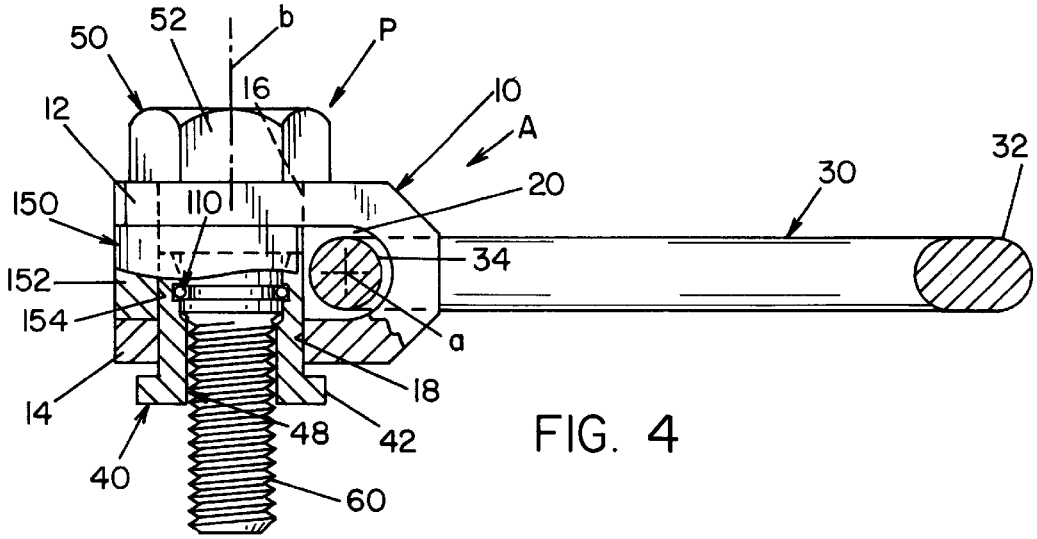
FIG. 4 is a partially cross sectional view taken generally along line 4—4 of FIG. 3.

Hoist ring A is provided with an additional element in the form of spacer 150, best shown in FIGS. 1–3. The spacer includes a generally C-shaped body 152 with a center bore 154 to fit loosely around the outer cylindrical surface of enlarged portion 56 of bolt 50 and cylindrical body 44 of bushing 40. These two components have generally the same outer diameter. To provide pivotal clearance for the straight small end 34 of load ring 30, body 152 is cut away to define spaced ends 156, 158. Spacer 150 prevents legs 12, 14 of clevis 10 from collapsing inward when load ring 30 is subjected to high forces. As shown in FIG. 3, spacer 150 also limits axial sliding movement of ring 30 in the direction of the arrows in this figure when ring 30 is rotated over the top of post assembly P. In practice, spacer 150 is formed from aluminum and is color coded to indicate the size and/or capacity of hoist ring A. Center bore 154 has an arcuate length greater than 180° so ends 156, 158 hold the spacer in position around post assembly P and between legs 12, 14.

Figure 8:
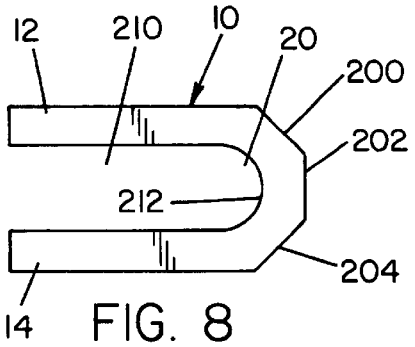
FIG. 8 is an end view of the U-shaped clevis forming a part of the present invention.
Figure 9:
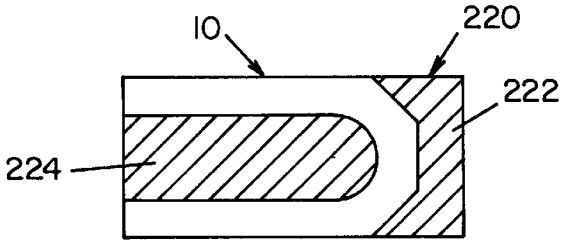
FIG. 9 is an end view showing in cross hatching the machining of a bar stock or extruded to form the clevis shown in FIG. 8.
Figure 11A:
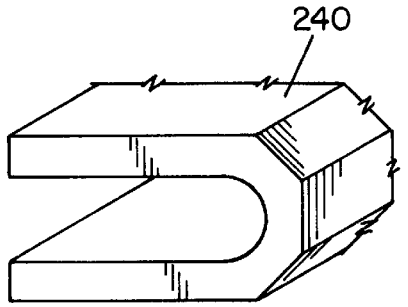
FIG. 11A is a pictorial view of an extrusion to form the clevis shown in FIG. 8.
Figure 11B:
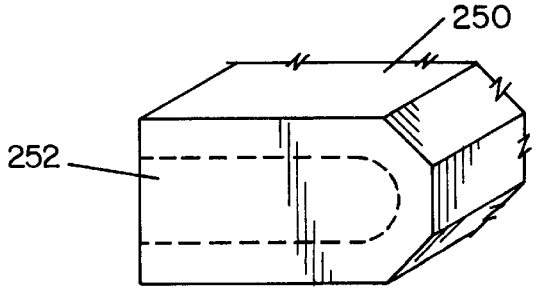
FIG. 11B is a view similar to FIG. 11A wherein the clevis is relatively small and the central opening is machined from an extrusion to form a clevis as shown in FIG. 8.
Figure 10:
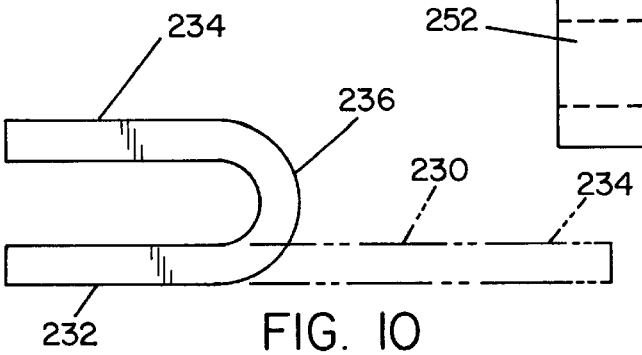
FIG. 10 is an end view showing a plate of steel in phantom lines and how it is bent to form the clevis shown in FIG. 8.

In accordance with another aspect of the present invention, the rotating clevis 10 for a side-pull hoist ring is not cast iron or steel but is formed from an extruded steel, steel bar stock or bent plate steel. As shown in FIG. 8, clevis 10 has an outer nose formed by flats 200, 202 and 204. An internal groove 210 terminates in an outer cylindrical end 212 defining bight portion 20 defining pivotal axis a of load ring 30. In practice the clevis 10 is formed of 4140 heat treated steel with holes 16, 18 formed in the steel before the heat treatment. In accordance with this aspect of the invention, clevis 10 is not formed of cast iron or steel. One procedure for forming the clevis is shown in FIG. 9 wherein a solid block of extrusion or bar stock 220 is cut to width and has milled or machined portions 222, 224 removed to define the clevis shown in FIG. 8. In a like manner, a heavy plate, such as a ⅜ inch thick steel plate 230 having ends 232, 234, is bent at 236, as shown in FIG. 10, to form clevis 10. As an alternative, the clevis can be extruded in the shape shown in FIG. 8 as a long extrusion 240 that is cut in lengths to give the proper width for the clevis and then drilled to form the rotating clevis. This procedure, used to make clevis 10, is shown in FIG. 11A where the extrusion 240 has the shape of the clevis shown in FIG. 8. In a like manner, a steel extrusion 250, as shown in FIG. 11B, is cut to length (width) to form the rotating clevis of FIG. 8. A milled groove 252, shown in dashed lines, forms the center groove 210 and circular end 212 of clevis 10 shown in FIG. 8. The procedure illustrated in FIG. 11B is used when a relatively small clevis is necessary for a smaller hoist ring. Larger hoist rings allow the clevis to be extruded in final shape as shown in FIG. 11A, which is the preferred procedure for forming clevis 10 shown in FIG. 8.

Having thus defined the invention, the following is claimed:

1. In a hoist ring for fixed engagement in a threaded bore on an outer surface of a load member, said hoist ring having a load carrying ring, a support member pivotally supporting said load carrying ring for rotation about a first axis generally parallel to said surface and a post assembly extending through said support member and fixedly engageable with said threaded bore for allowing 360° rotation of said support member about a second axis generally perpendicular to said surface, the improvement comprising: said post assembly including a lower support bushing with a lower load bearing flange and a bolt receiving passageway coaxial with said second axis; a bolt extending through said passageway into said threaded bore of said load member, said bolt having a head carrying an upper flange member coacting with said lower flange to capture said support member and a shank; and, a transversely expandable and contractable arcuate element to permanently lock said shank into said passageway.

2. The improvement as defined in claim 1 wherein said post assembly further comprises a first cylinder groove in said passageway, a second cylindrical groove around said shank, said grooves being axially aligned when said lower flange and said upper flange capture said support member and said arcuate element having a collapsed shape generally retained in said second groove and a relaxed shape bottomed out in said first groove and extending between said first and second grooves to prevent non-destructive axial removal of said bolt from said bushing.

3. The improvement as defined in claim 2 wherein said arcuate element is a generally C-shaped spring.

4. The improvement as defined in claim 3 wherein said arcuate element has a cross sectional shape with a maximum radial dimension and said second groove has a depth which, when added to the clearance between said shank and said passageway, is greater than said maximum radial dimension of said spring element.

5. The improvement as defined in claim 4 wherein said post assembly further includes said bushing having a generally conical lead-in portion above said first cylindrical groove in said bolt receiving passageway, said lead-in portion formed at a given angle with respect to said second axis.

6. The improvement as defined in claim 5 wherein said given angle is in the general range of 15°–30°.

7. The improvement as defined in claim 5 wherein said bushing has a top end and said shank having an enlarged cylindrical portion above said second groove with a downwardly facing shoulder, said shoulder and top end being in generally abutting relationship when said grooves are axially aligned.

8. The improvement as defined in claim 4 wherein said bushing has a top end and said shank having an enlarged cylindrical portion above said second groove with a downwardly facing shoulder, said shoulder and top end being in generally abutting relationship when said grooves are axially aligned.

9. The improvement as defined in claim 2 wherein said bushing has a top end and said shank having an enlarged cylindrical portion above said second groove with a downwardly facing shoulder, said shoulder and top end being in generally abutting relationship when said grooves are axially aligned.

10. The improvement as defined in claim 9 wherein said arcuate element is a generally C-shaped spring.

11. The improvement as defined in claim 2 wherein said arcuate element has a cross sectional shape with a maximum radial dimension, and said second groove has a depth which, when added to the clearance between said shank and said passageway, is greater than said maximum radial dimension of said spring element.

12. The improvement as defined in claim 11 wherein said bushing has a top end and said shank having an enlarged cylindrical portion above said second groove with a downwardly facing shoulder, said shoulder and top end being in generally abutting relationship when said grooves are axially aligned.

13. The improvement as defined in claim 2 wherein said post assembly further includes said bushing having a generally conical lead-in portion above said first cylindrical groove in said bolt receiving passageway, said lead-in portion formed at a given angle with respect to said second axis.

14. The improvement as defined in claim 13 wherein said arcuate element is a generally C-shaped spring.

15. The improvement as defined in claim 13 wherein said given angle is in the general range of 15°–30°.

16. The improvement as defined in claim 2 wherein said upper flange is integral with said head of said bolt.

17. The improvement as defined in claim 16 wherein said support member is a generally U-shaped clevis with aligned holes receiving said post assembly and a bight defining said first axis.

18. The improvement as defined in claim 17 wherein said clevis is formed of a bent sheet steel.

19. The improvement as defined in claim 17 wherein said clevis is extruded steel.

20. The improvement as defined in claim 17 wherein said clevis is machined from a steel stock.

21. The improvement as defined in claim 1 wherein said upper flange is integral with said head of said bolt.

22. The improvement as defined in claim 2 wherein said support member is a generally U-shaped clevis with aligned holes receiving said post assembly and a bight defining said first axis.

23. The improvement as defined in claim 22 wherein said clevis is formed of a bent sheet steel.

24. The improvement as defined in claim 22 wherein said clevis is extruded steel.

25. The improvement as defined in claim 22 wherein said clevis is machined from a steel stock.

26. The improvement as defined in claim 1 wherein said support member is a generally U-shaped clevis with aligned holes receiving said post assembly and a bight defining said first axis.

27. The improvement as defined in claim 26 wherein said clevis is formed of a bent sheet steel.

28. The improvement as defined in claim 26 wherein said clevis is extruded steel.

29. The improvement as defined in claim 26 wherein said clevis is machined from a steel stock.

30. In a hoist ring for fixed engagement in a threaded bore on an outer surface of a load member, said hoist ring having a load carrying ring, a support member pivotally supporting said load carrying ring for rotation about a first axis generally parallel to said surface and a post assembly extending through said support member and fixedly engageable with said threaded bore for allowing 360° rotation of said support member about a second axis generally perpendicular to said surface, the improvement comprising: said post assembly including a lower support bushing with a lower load bearing flange and a bolt receiving passageway coaxial with said second axis; a bolt extending through said passageway into said threaded bore of said load member, said bolt having a head carrying an upper flange member coacting with said lower flange to capture said support member and a shank; and, wherein said support member is a generally U-shaped clevis with aligned holes receiving said post assembly and a bight portion defining said first axis.

31. The improvement as defined in claim 30 wherein said clevis is formed of a bent sheet steel.

32. The improvement as defined in claim 30 wherein said clevis is extruded steel.

33. The improvement as defined in claim 30 wherein said clevis is machined from a steel stock.

34. In a hoist ring for fixed engagement in a threaded bore on an outer surface of a load member, said hoist ring having a load carrying ring, a support member pivotally supporting said load carrying ring for rotation about a first axis generally parallel to said surface and a post assembly extending through said support member and fixedly engageable with said threaded bore for allowing 360° rotation of said support member about a second axis generally perpendicular to said surface, the improvement comprising: said post assembly including a lower support bushing with a lower load bearing flange and a bolt receiving passageway coaxial with said second axis; a bolt extending through said passageway into said threaded bore of said load member, said bolt having a head carrying an upper flange member coacting with said lower flange to capture said support member and a shank; a first cylinder groove in said passageway; a second cylindrical groove around said shank; said grooves being axially aligned when said lower flange and said upper flange capture said support member; and, an arcuate spring element having a collapsed shape generally retained in said second groove and a relaxed shape bottomed out in said first groove and extending between said first and second grooves to prevent non-destructive axial removal of said bolt from said bushing.

35. The improvement as defined in claim 34 wherein said spring element is a generally C-shaped spring.

36. The improvement as defined in claim 34 wherein said spring element has a cross sectional shape with a maximum radial dimension, and said second groove has a depth which, when added to the clearance between said shank and said passageway, is greater than said maximum radial dimension of said spring element.

37. The improvement as defined in claim 34 wherein includes said bushing having a generally conical lead-in portion above said first cylindrical groove in said bolt receiving passageway, said lead-in portion formed at a given angle with respect to said second axis.

38. The improvement as defined in claim 37 wherein said given angle is in the general range of 15°–30°.

39. The improvement as defined in claim 34 wherein said bushing has a top end and said shank having an enlarged cylindrical portion above said second groove with a downwardly facing shoulder, said shoulder and top end being in generally abutting relationship when said grooves are axially aligned.

40. The improvement as defined in claim 34 wherein said upper flange is integral with said head of said bolt.

41. The improvement as defined in claim 34 wherein said support member is a generally U-shaped clevis with aligned holes receiving said post assembly and a bight defining said first axis.

42. The improvement as defined in claim 41 wherein said clevis is formed of a bent sheet steel.

43. The improvement as defined in claim 41 wherein said clevis is extruded steel.

44. The improvement as defined in claim 41 wherein said clevis is machined from a steel stock.

45. In a hoist ring for fixed engagement in a threaded bore on an outer surface of a load member, said hoist ring having a load carrying ring, a support member pivotally supporting said load carrying ring for rotation about a first axis generally parallel to said surface and a post assembly extending through said support member and fixedly engageable with said threaded bore for allowing 360° rotation of said support member about a second axis generally perpendicular to said surface, the improvement comprising: said post assembly including a lower support bushing with a lower load bearing flange and a bolt receiving passageway coaxial with said second axis; a bolt extending through said passageway into said threaded bore of said load member, said bolt having a head carrying an upper flange member coacting with said lower flange to capture said support member and a shank; and, means for locking said shank into said passageway; wherein said locking means comprises a first cylinder groove in said passageway, a second cylindrical groove around said shank, said grooves being axially aligned when said lower flange and said upper flange capture said support member and an arcuate generally C-shaped spring element having a collapsed shape generally retained in said second groove and a relaxed shape bottomed out in said first groove and extending between said first and second grooves to prevent non-destructive axial removal of said bolt from said bushing; said spring element having a cross sectional shape with a maximum radial dimension and said second groove has a depth which, when added to the clearance between said shank and said passageway, is greater than said maximum radial dimension of said spring element; said bushing having a generally conical lead-in portion above said first cylindrical groove in said bolt receiving passageway, said lead-in portion formed at a given angle with respect to said second axis.

46. The improvement as defined in claim 45, wherein said given angle is in the general range of 15°–30°.

47. The improvement as defined in claim 45, wherein said bushing has a top end and said shank having an enlarged cylindrical portion above said second groove with a downwardly facing shoulder, said shoulder and top end being in generally abutting relationship when said grooves are axially aligned.

48. In a hoist ring for fixed engagement in a threaded bore on an outer surface of a load member, said hoist ring having a load carrying ring, a support member pivotally supporting said load carrying ring for rotation about a first axis generally parallel to said surface and a post assembly extending through said support member and fixedly engageable with said threaded bore for allowing 360° rotation of said support member about a second axis generally perpendicular to said surface, the improvement comprising: said post assembly including a lower support bushing with a lower load bearing flange and a bolt receiving passageway coaxial with said second axis; a bolt extending through said passageway into said threaded bore of said load member, said bolt having a head carrying an upper flange member coacting with said lower flange to capture said support member and a shank; and, means for locking said shank into said passageway; wherein said locking means comprises a first cylinder groove in said passageway, a second cylindrical groove around said shank, said grooves being axially aligned when said lower flange and said upper flange capture said support member and an arcuate spring element having a collapsed shape generally retained in said second groove and a relaxed shape bottomed out in said first groove and extending between said first and second grooves to prevent non-destructive axial removal of said bolt from said bushing; said spring element having a cross sectional shape with a maximum radial dimension and said second groove has a depth which, when added to the clearance between said shank and said passageway, is greater than said maximum radial dimension of said spring element; wherein said bushing has a top end and said shank having an enlarged cylindrical portion above said second groove with a downwardly facing shoulder, said shoulder and top end being in generally abutting relationship when said grooves are axially aligned.

49. In a hoist ring for fixed engagement in a threaded bore on an outer surface of a load member, said hoist ring having a load carrying ring, a support member pivotally supporting said load carrying ring for rotation about a first axis generally parallel to said surface and a post assembly extending through said support member and fixedly engageable with said threaded bore for allowing 360° rotation of said support member about a second axis generally perpendicular to said surface, the improvement comprising: said post assembly including a lower support bushing with a lower load bearing flange and a bolt receiving passageway coaxial with said second axis; a bolt extending through said passageway into said threaded bore of said load member, said bolt having a head carrying an upper flange member coacting with said lower flange to capture said support member and a shank; and, means for locking said shank into said passageway; said locking means comprises a first cylinder groove in said passageway, a second cylindrical groove around said shank, said grooves being axially aligned when said lower flange and said upper flange capture said support member and an arcuate spring element having a collapsed shape generally retained in said second groove and a relaxed shape bottomed out in said first groove and extending between said first and second grooves to prevent non-destructive axial removal of said bolt from said bushing; wherein said bushing has a top end and said shank having an enlarged cylindrical portion above said second groove with a downwardly facing shoulder, said shoulder and top end being in generally abutting relationship when said grooves are axially aligned.

50. The improvement as defined in claim 49, wherein said spring element is a generally C-shaped spring.

51. In a hoist ring for fixed engagement in a threaded bore on an outer surface of a load member, said hoist ring having a load carrying ring, a support member pivotally supporting said load carrying ring for rotation about a first axis generally parallel to said surface and a post assembly extending through said support member and fixedly engageable with said threaded bore for allowing 360° rotation of said support member about a second axis generally perpendicular to said surface, the improvement comprising: said post assembly including a lower support bushing with a lower load bearing flange and a bolt receiving passageway coaxial with said second axis; a bolt extending through said passageway into said threaded bore of said load member, said bolt having a head carrying an upper flange member coacting with said lower flange to capture said support member and a shank; and, means for locking said shank into said passageway; said locking means comprises a first cylinder groove in said passageway, a second cylindrical groove around said shank, said grooves being axially aligned when said lower flange and said upper flange capture said support member and an arcuate spring element having a collapsed shape generally retained in said second groove and a relaxed shape bottomed out in said first groove and extending between said first and second grooves to prevent non-destructive axial removal of said bolt from said bushing; said spring element having a cross-sectional shape with a maximum radial dimension, and said second groove has a depth which, when added to the clearance between said shank and said passageway, is greater than said maximum radial dimension of said spring element; wherein said bushing has a top end and said shank having an enlarged cylindrical portion above said second groove with a downwardly facing shoulder, said shoulder and top end being in generally abutting relationship when said grooves are axially aligned.

52. In a hoist ring for fixed engagement in a threaded bore on an outer surface of a load member, said hoist ring having a load carrying ring, a support member pivotally supporting said load carrying ring for rotation about a first axis generally parallel to said surface and a post assembly extending through said support member and fixedly engageable with said threaded bore for allowing 360° rotation of said support member about a second axis generally perpendicular to said surface, the improvement comprising: said post assembly including a lower support bushing with a lower load bearing flange and a bolt receiving passageway coaxial with said second axis; a bolt extending through said passageway into said threaded bore of said load member, said bolt having a head carrying an upper flange member coacting with said lower flange to capture said support member and a shank; and, means for locking said shank into said passageway; said locking means comprises a first cylinder groove in said passageway, a second cylindrical groove around said shank, said grooves being axially aligned when said lower flange and said upper flange capture said support member and an arcuate spring element having a collapsed shape generally retained in said second groove and a relaxed shape bottomed out in said first groove and extending between said first and second grooves to prevent non-destructive axial removal of said bolt from said bushing; wherein said locking means includes said bushing having a generally conical lead-in portion above said first cylindrical groove in said bolt receiving passageway, said lead-in portion formed at a given angle with respect to said second axis.

53. The improvement as defined in claim 52, wherein said spring element is a generally C-shaped spring.

54. The improvement as defined in claim 52, wherein said given angle is in the general range of15°–30°.

55. In a hoist ring for fixed engagement in a threaded bore on an outer surface of a load member, said hoist ring having a load carrying ring, a support member pivotally supporting said load carrying ring for rotation about a first axis generally parallel to said surface and a post assembly extending through said support member and fixedly engageable with said threaded bore for allowing 360° rotation of said support member about a second axis generally perpendicular to said surface, the improvement comprising: said post assembly including a lower support bushing with a lower load bearing flange and a bolt receiving passageway coaxial with said second axis; a bolt extending through said passageway into said threaded bore of said load member, said bolt having a head carrying an upper flange member coacting with said lower flange to capture said support member and a shank; and, means for locking said shank into said passageway; said locking means comprises a first cylinder groove in said passageway, a second cylindrical groove around said shank, said grooves being axially aligned when said lower flange and said upper flange capture said support member and an arcuate spring element having a collapsed shape generally retained in said second groove and a relaxed shape bottomed out in said first groove and extending between said first and second grooves to prevent non-destructive axial removal of said bolt from said bushing; wherein said upper flange is integral with said head of said bolt and said support member is a generally U-shaped clevis with aligned holes receiving said post assembly and a bight defining said first axis.

56. The improvement as defined in claim 55, wherein said clevis is formed of a bent sheet steel.

57. The improvement as defined in claim 55, wherein said clevis is extruded steel.

58. The improvement as defined in claim 55, wherein said clevis is machined from a steel stock.

59. In a hoist ring for fixed engagement in a threaded bore on an outer surface of a load member, said hoist ring having a load carrying ring, a support member pivotally supporting said load carrying ring for rotation about a first axis generally parallel to said surface and a post assembly extending through said support member and fixedly engageable with said threaded bore for allowing 360° rotation of said support member about a second axis generally perpendicular to said surface, the improvement comprising: said post assembly including a lower support bushing with a lower load bearing flange and a bolt receiving passageway coaxial with said second axis; a bolt extending through said passageway into said threaded bore of said load member, said bolt having a head carrying an upper flange member coacting with said lower flange to capture said support member and a shank; and, means for locking said shank into said passageway; said locking means comprises a first cylinder groove in said passageway, a second cylindrical groove around said shank, said grooves being axially aligned when said lower flange and said upper flange capture said support member and an arcuate spring element having a collapsed shape generally retained in said second groove and a relaxed shape bottomed out in said first groove and extending between said first and second grooves to prevent non-destructive axial removal of said bolt from said bushing; wherein said support member is a generally U-shaped clevis with aligned holes receiving said post assembly and a bight defining said first axis.

60. The improvement as defined in claim 59, wherein said clevis is formed of a bent sheet steel.

61. The improvement as defined in claim 59, wherein said clevis is extruded steel.

62. The improvement as defined in claim 59, wherein said clevis is machined from a steel stock.

63. In a hoist ring for fixed engagement in a threaded bore on an outer surface of a load member, said hoist ring having a load carrying ring, a support member pivotally supporting said load carrying ring for rotation about a first axis generally parallel to said surface and a post assembly extending through said support member and fixedly engageable with said threaded bore for allowing 360° rotation of said support member about a second axis generally perpendicular to said surface, the improvement comprising: said post assembly including a lower support bushing with a lower load bearing flange and a bolt receiving passageway coaxial with said second axis; a bolt extending through said passageway into said threaded bore of said load member, said bolt having a head carrying an upper flange member coacting with said lower flange to capture said support member and a shank; and, means for locking said shank into said passageway; wherein said support member is a generally U-shaped clevis with aligned holes receiving said post assembly and a bight defining said first axis.

64. The improvement as defined in claim 63, wherein said clevis is formed of a bent sheet steel.

65. The improvement as defined in claim 63, wherein said clevis is extruded steel.

66. The improvement as defined in claim 63, wherein said clevis is machined from a steel stock.

67. In a hoist ring for fixed engagement in a threaded bore on an outer surface of a load member, said hoist ring having a load carrying ring, a support member pivotally supporting said load carrying ring for rotation about a first axis generally parallel to said surface and a post assembly extending through said support member and fixedly engageable with said threaded bore for allowing 360° rotation of said support member about a second axis generally perpendicular to said surface, the improvement comprising: said post assembly including a lower support bushing with a lower load bearing flange and a bolt receiving passageway coaxial with said second axis; a bolt extending through said passageway into said threaded bore of said load member, said bolt having a head carrying an upper flange member coacting with said lower flange to capture said support member and a shank; a first cylinder groove in said passageway; a second cylindrical groove around said shank; said grooves being axially aligned when said lower flange and said upper flange capture said support member; and, an arcuate spring element having a collapsed shape generally retained in said second groove and a relaxed shape bottomed out in said first groove and extending between said first and second grooves to prevent non-destructive axial removal of said bolt from said bushing; wherein said upper flange is integral with said head of said bolt.

68. In a hoist ring for fixed engagement in a threaded bore on an outer surface of a load member, said hoist ring having a load carrying ring, a support member pivotally supporting said load carrying ring for rotation about a first axis generally parallel to said surface and a post assembly extending through said support member and fixedly engageable with said threaded bore for allowing 360° rotation of said support member about a second axis generally perpendicular to said surface, the improvement comprising: said post assembly including a lower support bushing with a lower load bearing flange and a bolt receiving passageway coaxial with said second axis; a bolt extending through said passageway into said threaded bore of said load member, said bolt having a head carrying an upper flange member coacting with said lower flange to capture said support member and a shank; and, means for locking said shank into said passageway; said locking means includes said bushing having a generally conical lead-in portion in said bolt receiving passageway, said lead-in portion formed at a given angle with respect to said second axis.

* * * * *